United States Patent [19]

Thompson, Jr.

[11] Patent Number: 4,674,300

[45] Date of Patent: Jun. 23, 1987

[54] KNITTING MACHINE COUNTER

[76] Inventor: Robert W. Thompson, Jr., 949 6th, Clarkston, Wash. 99403

[21] Appl. No.: 834,397

[22] Filed: Feb. 28, 1986

[51] Int. Cl.[4] ..... D04B 9/02; D04B 15/00

[52] U.S. Cl. ..... 66/8

[58] Field of Search ..... 66/1 R, 8

[56] References Cited

U.S. PATENT DOCUMENTS

| | | | |
|---|---|---|---|
| 459,827 | 9/1891 | Gulick et al. | 66/8 X |
| 2,206,518 | 7/1940 | Strzalkowski | 66/1 R |
| 3,983,719 | 10/1976 | Rich et al. | 66/116 |

FOREIGN PATENT DOCUMENTS

| | | | |
|---|---|---|---|
| 630827 | 8/1927 | France | 66/8 |
| 5712 | of 1906 | United Kingdom | 66/8 |
| 21033 | of 1906 | United Kingdom | 66/8 |
| 859224 | 1/1961 | United Kingdom | 66/1 R |
| 2077305 | 12/1981 | United Kingdom | 66/1 R |

*Primary Examiner*—Wm. Carter Reynolds

[57] ABSTRACT

A knitting machine with a needle drive drum revolution counter that indicates the number of fabric rows knit. A cam rotates with the needle drive drum pivoting a switching arm that advances the counter.

4 Claims, 18 Drawing Figures

KNITTING MACHINE COUNTER

BACKGROUND OF THE INVENTION

The background of the invention will be set forth in two parts:

1. Field of the Invention

The present invention pertains generally to the field of knitting machines, and more particular to knitting machines with the ability to count the work production.

2. Description of the Prior Art

The prior art known to the applicant is listed by way of illustration, having limitations in separate communications to the U.S. Pat. Office. The present invention exemplifies improvements over the prior art.

More particularly U.S. Pat. No. 3,983,719, disclosing a knitting needle which turns in a circular motion, having reciprocating fingers used to load and unload thread as it turns in its circular path. It is apparent that the circular knitter had no mechanical means by which to count its circular rotations, or stabilize the knitting machine.

SUMMARY OF THE INVENTION

The circular loop loading knitting machine guides yarn at a given tension through needles, forming rows.

This invention accurately, through the incorporation of a swing arm counting device, will count these said rows.

At predetermined intervals, during the production of tubular work, regardless of speed placed upon the hand crank, the cam upon the apron of the needle embodiment, drive drum will cause a switching counter advance arm to pivot upward and downward upon the cam and counter, causing the counter to advance one, through its movements.

A spring present within the counter, placed below the advancement arm, thus returns the swing arm to the apron base as cam passes, preparing both the arm and counter for each additional revolution.

Upon completion of the tubular work, the shaft and zero return washers may be turned to engage small cams within the counter wheels, to reset the device for its next operation.

Additional physical features to the shell make the portable machine a stationary fixture. This is done by the addition of holes in its base.

Through stabilization the tubular knitting can then be made in excessive lengths, with the capability being numbered through the usage of a ratchet type counter.

The features of the present invention which are believed to be novel are set forth with particularity in the appended claims. The present invention, both as to its organization and the manner of operation, together with the further objects and advantages thereof, may best be understood reference to the following drawings, taken in connection with the accompanying drawings in which like reference characters refer to the like elements in several views.

DESCRIPTION OF THE PREFERRED EMBODIMENT

Figure 1:
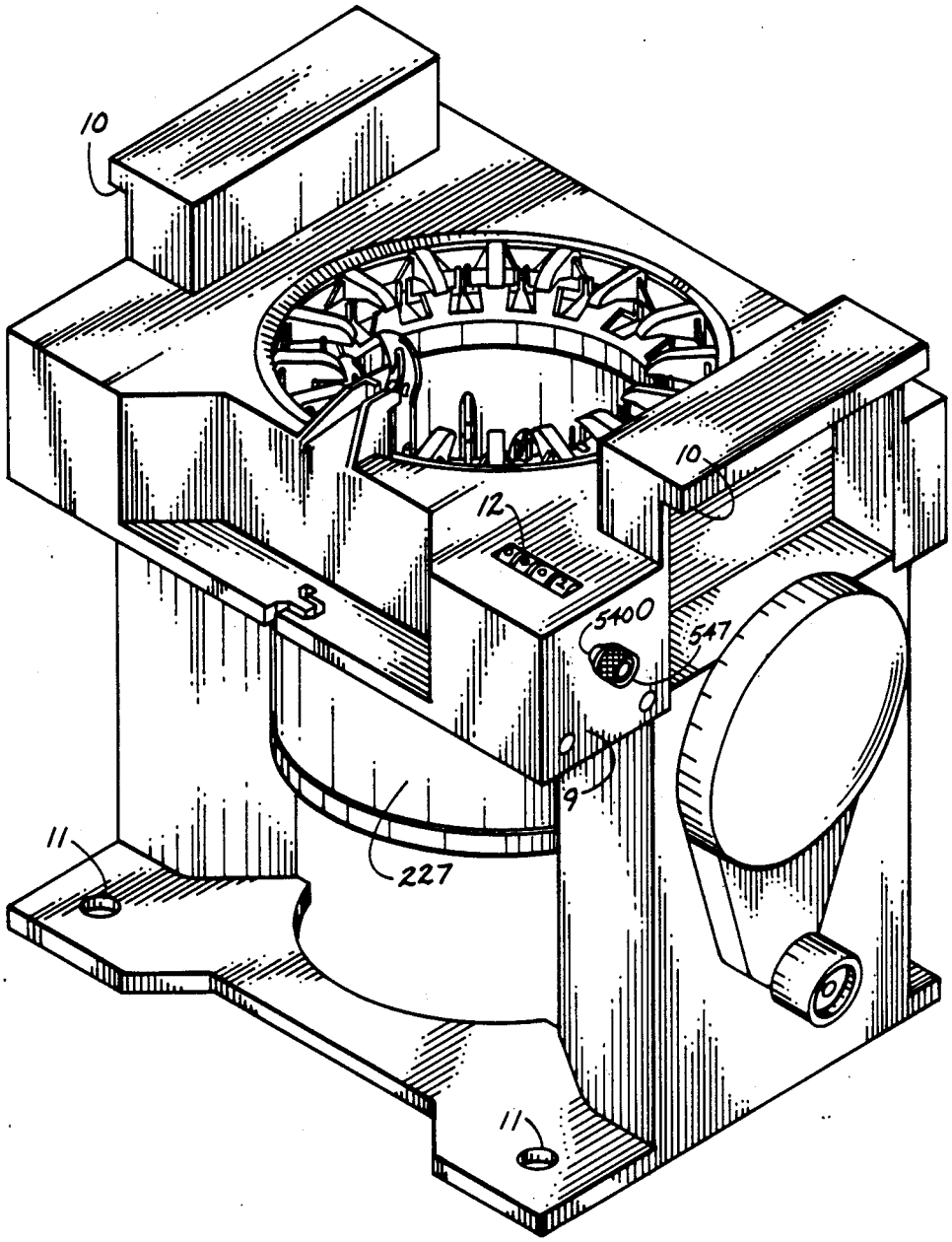
FIG. 1 is an elevation view of the knitting machine incorporating a counter, of the present invention, to show its external features.

Referring to the drawings of the counting knitting needle:

FIG. 1 is the Preferred Embodiment shown in an elevation drawing, with handles (10) provided with better finger placement for grasping the machine during usage and movement. The holes (11) at the base of the knitting machine case, make it possible to attach the knitter to a stationary surface for excessive lengths of knitting to be accomplished and counted through the use of counter 12, upon movement of the hand crank.

Figure 2:
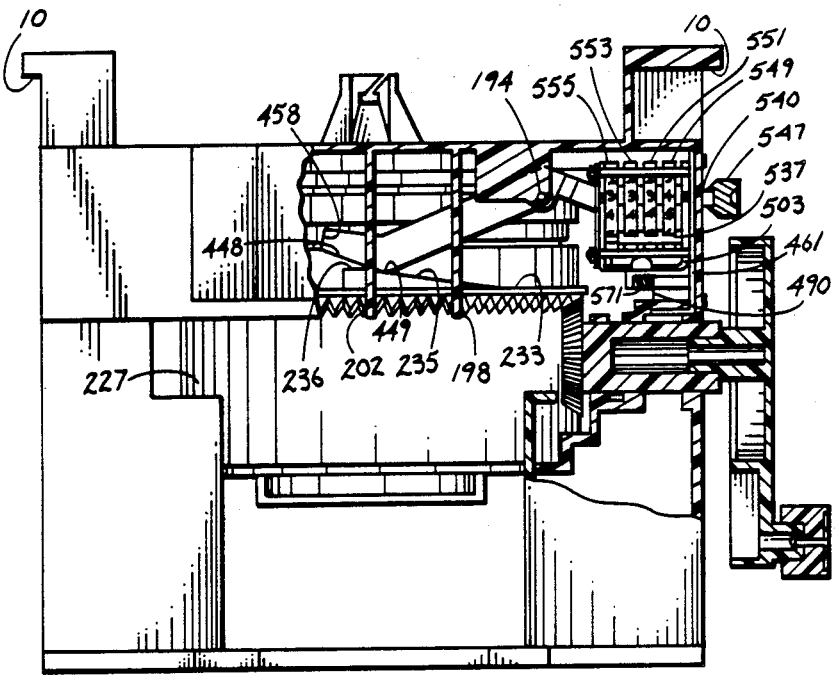
FIG. 2 is an elevation view with parts broken away to show internal construction of a knitting machine incorporating a cam, switch arm and counter device, of the present invention.
Figure 6:
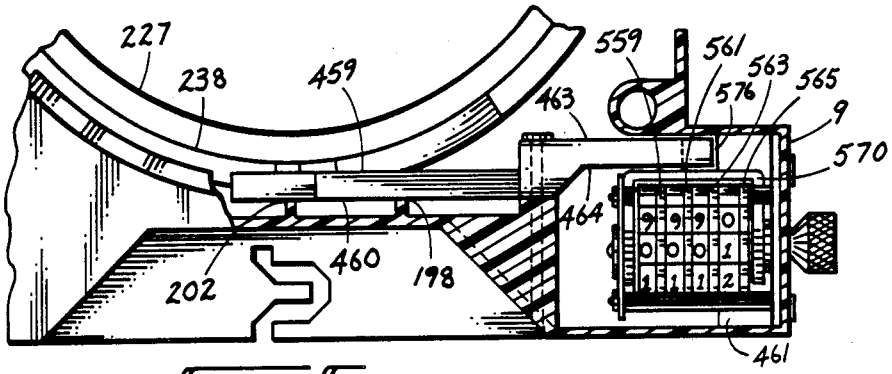
FIG. 6 is a top broken view of counter operation using cam, switch arm, and counter.
Figure 3B:
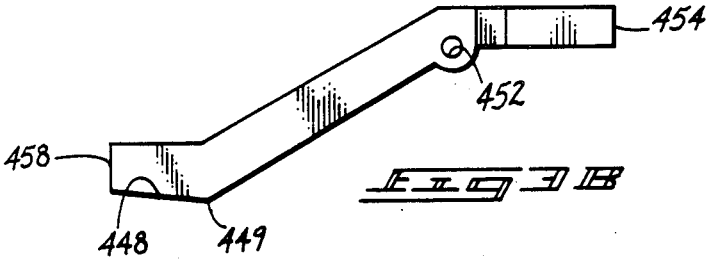
FIG. 3B is of the switching arm from a side view.
Figure 3A:
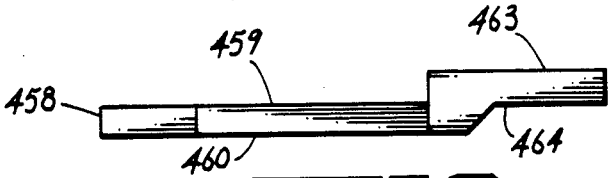
FIG. 3A is of the switching arm from the top view.

The internal structure is revealed in FIG. 2, a cut away side view, and FIG. 6, a cut away top view. The switching arm FIG. 3A, top view, and FIG. 3B, a side view, is stabilized in the case by means of a pin placed through hole 452 of the switching arm and inserted into hole 194 of the machine case, allowing the switching arm to be pivotable.

The surfaces 9, 198, 202 of the machine case, in combination with surface 238 of the Needle Drive Drum 227 and surface 570 of the counter advancement arm enclose the switching arm at surface points 459, 460, 463 and 464 causing minimal stress upon the pivot pin.

Figure 4:
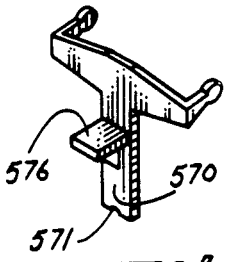
FIG. 4 is an elevation view of the counter advancing device.
Figure 7A:
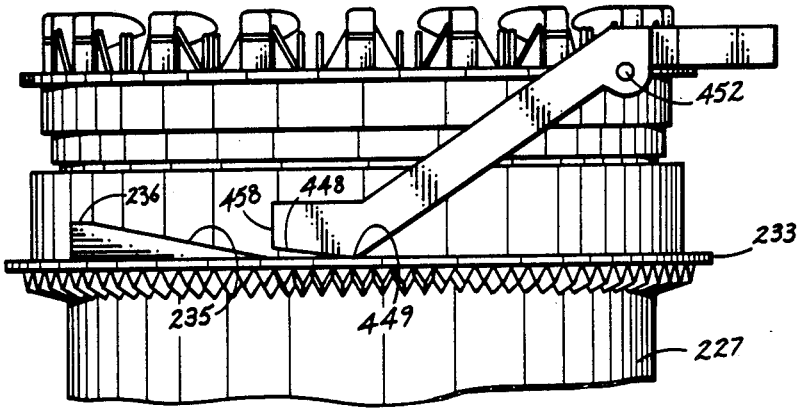
FIG. 7A is a side view of switch arm on cylindrical drum apron before meeting cam.
Figure 7B:
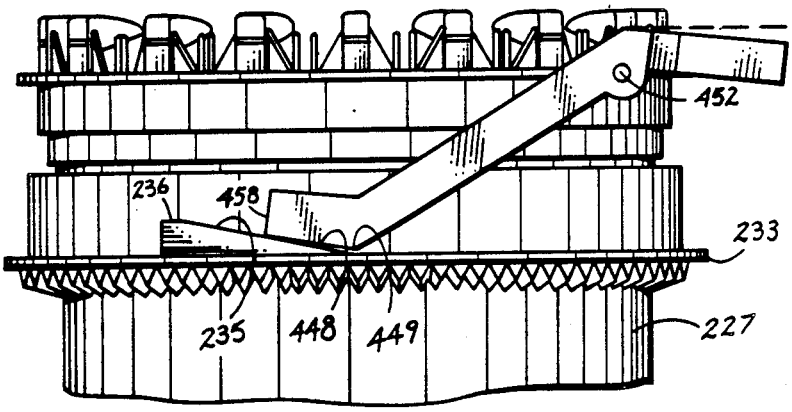
FIG. 7B is a side view of switch arm encountering cam.
Figure 7C:
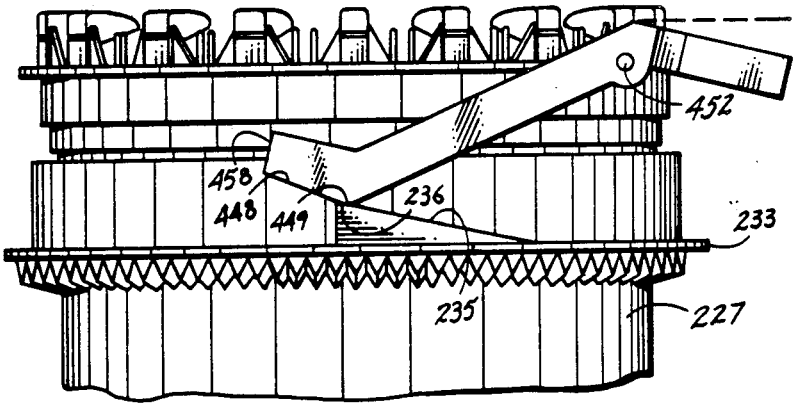
FIG. 7C is a side view of switch arm gaining its highest peak on cam, shown in FIGS. 2 and 6.
Figure 8A:
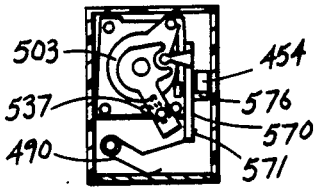
FIG. 8A is a broken view of the case disclosing the counter switch arm, with the counter at a starting position, relative to FIG. 7A.
Figure 9A:
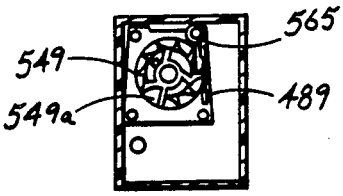
FIG. 9A discloses the counting wheels with reverse lock, in place, relative to FIGS. 6 and 8A.

The theoretical motion of the switching arm during usage is shown in FIG. 7A through 7C upon rotation of the Needle Drive Drum 227. FIG. 7A shows the switching arm with surface 449 upon the needle drive drum apron 233, which would be in the non-counting position. With the counter end 454 of the switching arm being placed upon plate 576 of the advancing device (FIG. 4) shown in FIG. 8A. Wheel locks 559, 561, 563, and 565 (FIG. 6) positions at this stage are shown in FIG. 9A, preventing movement of the counting wheels.

As the rotation of the Needle Drive Drum 227 begins shown FIG. 7B, surfaces 458 and 448, of the switching arm, begin to rise upon cam 235 with a non-jamming effect, due to a slight counter incline of the switching arm.

Figure 5:
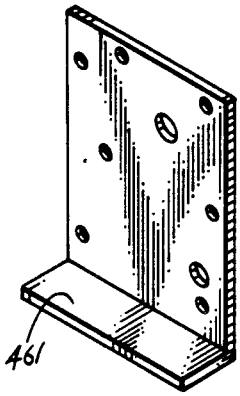
FIG. 5 is an elevation view of the counter holder.
Figure 8B:
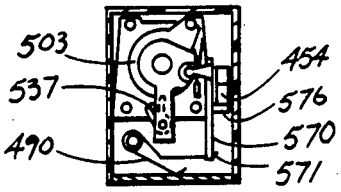
FIG. 8B is a broken view of case disclosing the counter at the bottom position relative to FIG. 7C.
Figure 9B:
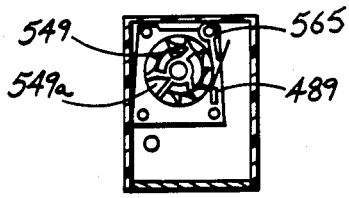
FIG. 9B discloses the counting wheels in motion relative to FIGS. 7B and 8B.

When surface 449 of the switching arm, reaches the highest point of the cam 236, FIG. 7C, the counter advancing arm moves downward compressing spring 490, FIG. 8B, upon surface 461 of the counter holder (FIG. 5). As this action is taking place, ratchet 503 with wheel advance 537 turn the first wheel 549, 1/10th of a revolution. During this movement wheel lock 565 moves outward, FIG. 9B, until spring 489 returns it to the counting wheel FIG. 9A, at the completion of the 1/10th revolution.

As the Needle Drive Drum 227 turns and the switching arm passes the cam 236, the return spring 490, held in notch 571 of the counter advancing arm, moving the counter advancing arm and switching arm upward, placing end 449 back upon the Needle Drive Drum Apron 233.

During this return motion the wheel locks hold the counting wheels in place, while wheel advance 537 and ratchet 503 move to their original position FIG. 8A.

The repetition of the above motions, are carried out 9 times per wheel, until wheel advance 537 slips into 549A of the counting wheel, thus moving 2 wheels at a time.

Figure 10A:
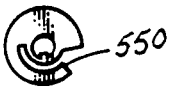
FIG. 10A is of the zero advance washer from a flat front view.
Figure 10B:
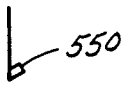
FIG. 10B is of the zero advance washer from a side view.
Figure 11A:
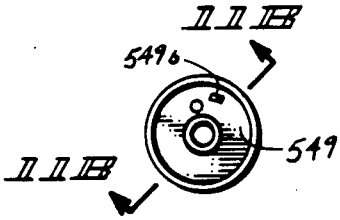
FIG. 11A is of the zero advance cam on the inner portion of the counting wheels from a flat front view.
Figure 11B:
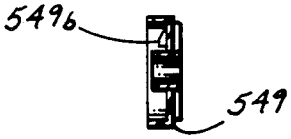
FIG. 11B is of the zero advance cam of the inner portion of the counting wheels viewed in a side cut away drawing.

Upon completion of a knitted work, the counter may be reset to zero. This is accomplished through the clockwise turning of knob 547 placed on shaft 540, with return washers 550, FIG. 10A, 10B, catching wheel zero cams 549B, FIG. 11A, 11B, releasing wheel locks 559, 561, 563, and 565, turning counter wheels 553, 553, 551, and 549 and resetting a zero count.

The advantages herein before stated, it is to be understood that it is merely illustrative of the presently preferred embodiment of the invention and that no limitations are intended to the details of the construction or design herein shown other than as defined in the appended claims, which form part of this disclosure.

What is claimed is:

1. A counter device including a counter advancement arm and ratchet type counter that will count accurately the rows formed by a circular knitting machine, at predetermined intervals, during the production of knitted tubular work, regardless of the speed of rotation of a crank, said machine including a cam upon an apron of a needle drive drum, said needle drive drum having needles mounted therein said crank providing motion to said drum, said drum when moved causing said counter advancement arm to pivot with one end thereof engaging the cam and another end thereof advancing a ratchet counter, causing the counter to advance one count, per one revolution of said drum.

2. The counter device of claim 1 wherein a spring present within said ratchet counter biasses said another end of said advancement arm to cause said one end to engage said cam.

3. The counter device of claim 1 or 2, wherein said ratchet counter can be manually reset to zero.

4. The counter device of claim 2 wherein said spring biasses said another end of said advancement arm to cause said one end to engage said apron.

* * * * *